US012467257B2

(12) United States Patent
Mooney

(10) Patent No.: US 12,467,257 B2
(45) Date of Patent: Nov. 11, 2025

(54) METHOD OF CONSTRUCTING FULL AND PARTIAL ROOFS FOR BUILDINGS

(71) Applicant: Travis Mooney, Burnsville, MN (US)

(72) Inventor: Travis Mooney, Burnsville, MN (US)

( * ) Notice: Subject to any disclaimer, the term of this patent is extended or adjusted under 35 U.S.C. 154(b) by 250 days.

(21) Appl. No.: 18/216,811

(22) Filed: Jun. 30, 2023

(65) Prior Publication Data

US 2025/0003215 A1 Jan. 2, 2025

(51) Int. Cl.
*E04B 7/02* (2006.01)
*E04D 13/17* (2006.01)

(52) U.S. Cl.
CPC ..... *E04B 7/026* (2013.01); *E04D 13/17* (2013.01)

(58) Field of Classification Search
CPC ..... E04B 7/20; E04B 7/026
USPC ..... 52/745.06, 745.2, 125.2
See application file for complete search history.

(56) References Cited

U.S. PATENT DOCUMENTS 2,882,557 A * 4/1959 Jaeger ..... E04B 1/10 52/92.1
4,703,603 A * 11/1987 Hills ..... F16B 5/0028 52/582.1
4,796,350 A * 1/1989 French ..... E04B 7/20 269/910
5,067,299 A * 11/1991 French ..... E04G 21/14 52/745.2
7,665,251 B1 * 2/2010 Lang ..... E04B 5/10 52/93.2
2003/0188495 A1 * 10/2003 Taylor ..... E04B 7/026 52/93.1
2009/0282768 A1 * 11/2009 Noturno ..... F16B 5/0028 52/582.1

FOREIGN PATENT DOCUMENTS

FR 2411283 A1 * 7/1979
GB 2355274 A * 4/2001 ..... E04B 7/20
WO WO-9429537 A1 * 12/1994 ..... E04B 7/026

* cited by examiner

*Primary Examiner* — Adriana Figueroa
(74) *Attorney, Agent, or Firm* — Dakota Law PLLC; Gary L. Huusko

(57) ABSTRACT

The constructing of roof panels at ground level (flat) to be lifted from ground level and attached to the roof trusses already in place substantially reducing the time spent on the roof and inherent danger of roofing above-ground level.

10 Claims, 14 Drawing Sheets

METHOD OF CONSTRUCTING FULL AND PARTIAL ROOFS FOR BUILDINGS

BACKGROUND OF INVENTION

As recently as the late 1990's, safety measures in the housing construction industry were rarely fully enforced. As an example, in the residential roofing construction trade, carpenters would put two by four toe-kicks on the first row of roof sheathing only. In the early 2000's, construction companies began adding safety measures to the process of installing roof sheathing in order to meet OSHA requirements.

In the late 2000's, safety regulation requirements started to become more strict. At first, roofers were required to have guard rails at 42" and 21" from the first row of roof sheathing. About 5 years later, the industry determined that those measures were not adequate. Those measures allowed for the sides of the roof to be left open, which created a hazard for a person to potentially fall into. Additional safety measures were instituted, including the requirement for the roofers to be tied off using a rope and harness. That measure proved to be ineffective due to the ropes not being tight at all times. Current safety requirements include the use of retractable cables, and continuing the requirement of putting two by four toe-kicks down.

It became clear that increased exposure time on the roof while laying roof sheathing correlated to increased accidents and injuries. An invention that would cut down the exposure time on the roof while laying roof sheathing, thus reducing accidents and injuries, was needed in the industry. One solution was to lay out the roof sheathing for appropriate roof truss locations. By knowing the layout of the roof trusses, the starter and finisher pieces of roof sheathing could be precut. The roof vents in the roof sheathing could also be precut before putting the roof sheathing on the roof trusses. These solutions, while saving some time on the roof did not appreciably reduce exposure time on the roof. This invention minimizes exposure time on the roof and decreases the amount of time of any roofing project by utilizing five components, the roof truss layout, the house dimensions, the roof overhang, the roof pitch, and the top truss chord length.

There have been several attempts to construct roofs either offsite or in whole home manufacturing facilities, to attempt to alleviate the risks inherent in common roofing practices, i.e., roofers spending an inordinate amount of time high upon rooftops installing the roof subassembly, moisture barrier and shingles.

For example, U.S. Pat. No. 6,000,192 by Cohen, et al (the '192 patent), describes a method of manufacturing standard size dwellings using a movable manufacturing facility wherein several subassembly production lines are present, including a roof subassembly for assembly of a roof on to a standard size dwelling, which said dwelling is located on a transport element to be moved to an end location. While patent '192 provides the roof being assembled at ground level, it requires the entire roof structure, including beams and trusses, to be assembled and lifted onto the house. The roof structure would be very heavy, requiring a high capacity crane to lift it onto the house, creating additional inherent safety concerns.

BRIEF SUMMARY OF INVENTION

The present invention describes constructing the roof panels at ground level (flat) to be lifted from ground level and attached to the roof trusses already in place. This lifting would only require a forklift or rough terrain boom lift. Two story structures may require a boom crane, but would not require a high capacity crane. The present invention also provides that the roof panels could be constructed off-site in accordance with the roof specifications and dimensions and transported to the building site. The roof panels of the present invention would lay flat for transportation, thus not requiring the controlled access roadway to individual sites needed in the prior art. The present invention substantially reduces the time spent on the roof, requiring the roofers only to place the moisture barrier and shingles on the roof subassembly.

DETAILED DESCRIPTION OF THE INVENTION

Figures 1A, 1B:
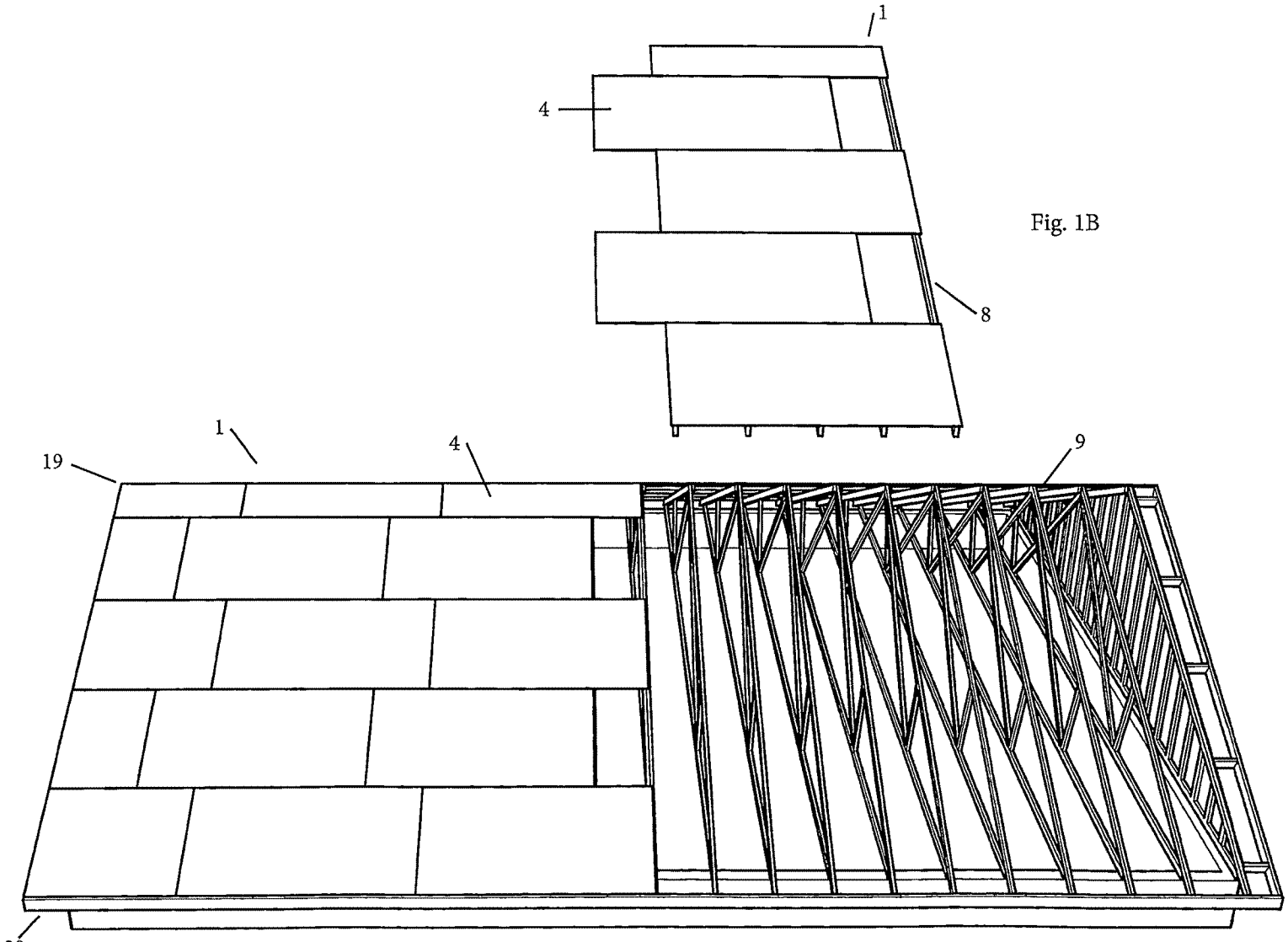
FIG. 1A shows the roof panel 1 comprising the attached roof sheathing 4, attached on roof trusses 9.
FIG. 1B shows the roof panel 1 with the roof sheathing 4 panel and panel frame 8.
Figure 2A:
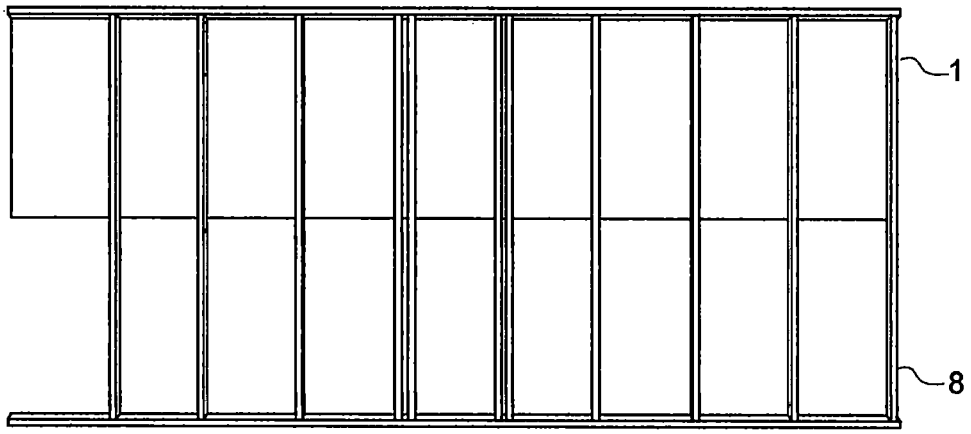
FIG. 2A is a bottom view of a roof panel 1 showing also the panel frame 8.
Figure 2B:
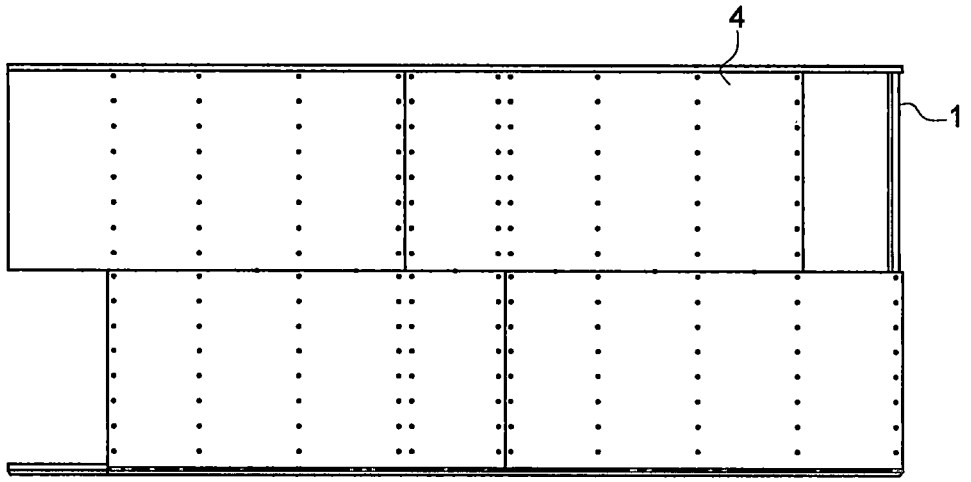
FIG. 2B is a top view of a roof panel 1 showing also the roof sheathing 4.
Figure 3A:
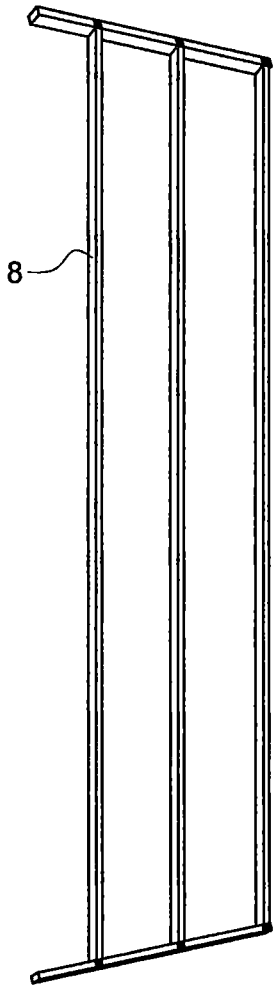
FIGS. 3A and 3B show a perspective and top view of the panel frame 8, respectively, and 3C shows a configuration of roof sheathing 4 orientation for a version of roof panel 1.
Figure 3B:
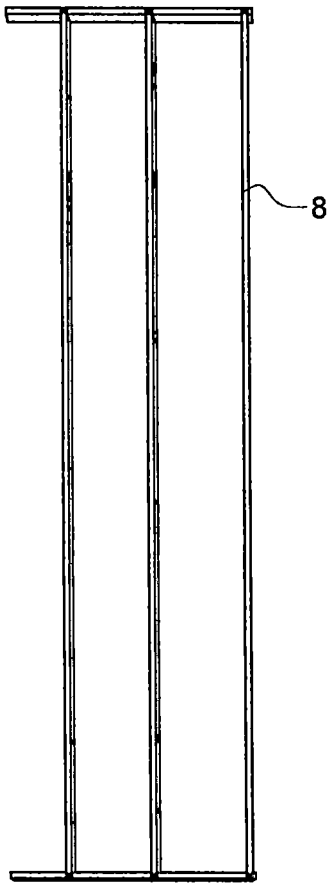
Figure 3C:
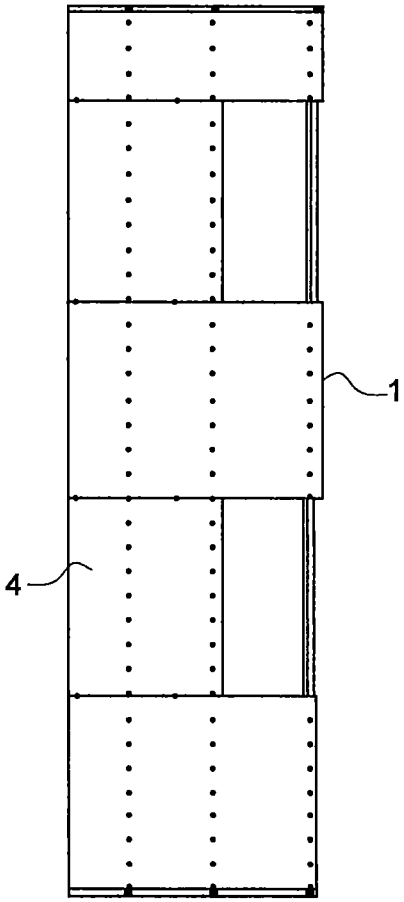
Figure 4A:
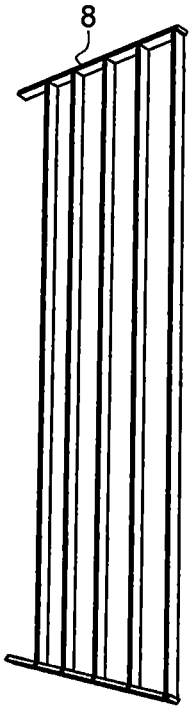
FIGS. 4A and 4B show a perspective and top view of another embodiment of the panel frame 8, respectively, and 4C shows another configuration of roof sheathing 4 orientation for a version of roof panel 1.
Figure 4B:
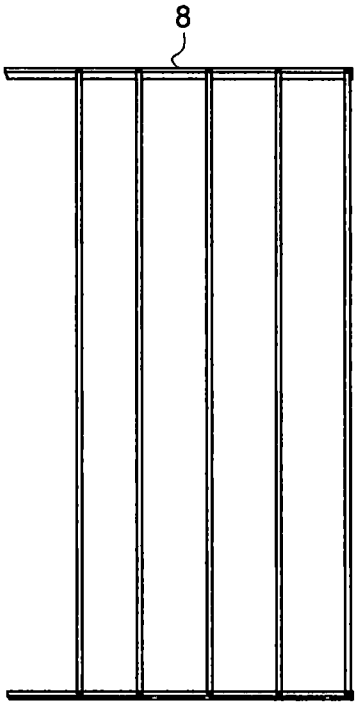
Figure 4C:
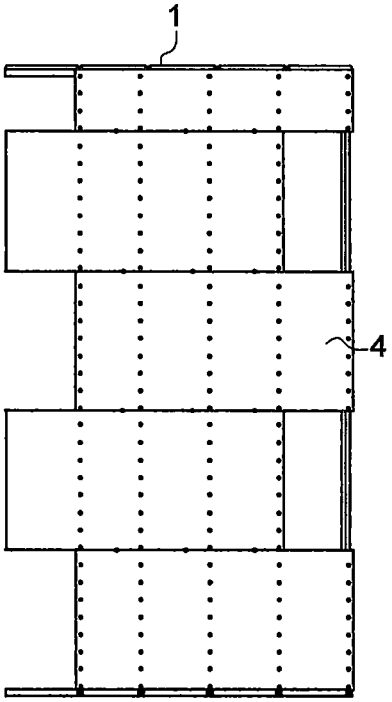
Figure 5A:
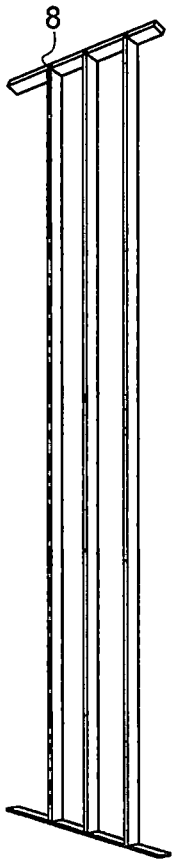
FIGS. 5A and 5B show a perspective and top view of another embodiment of the panel frame 8, respectively, and 5C shows another configuration of roof sheathing 4 orientation for a version of roof panel 1.
Figure 5B:
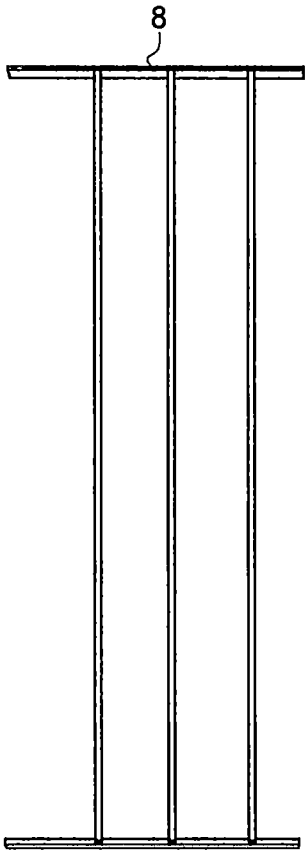
Figure 5C:
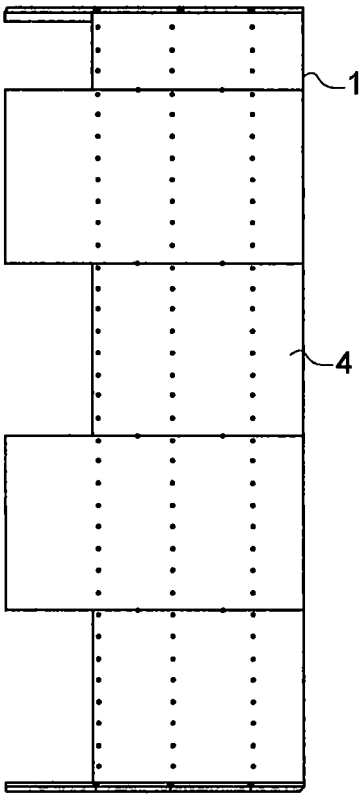
Figure 6:
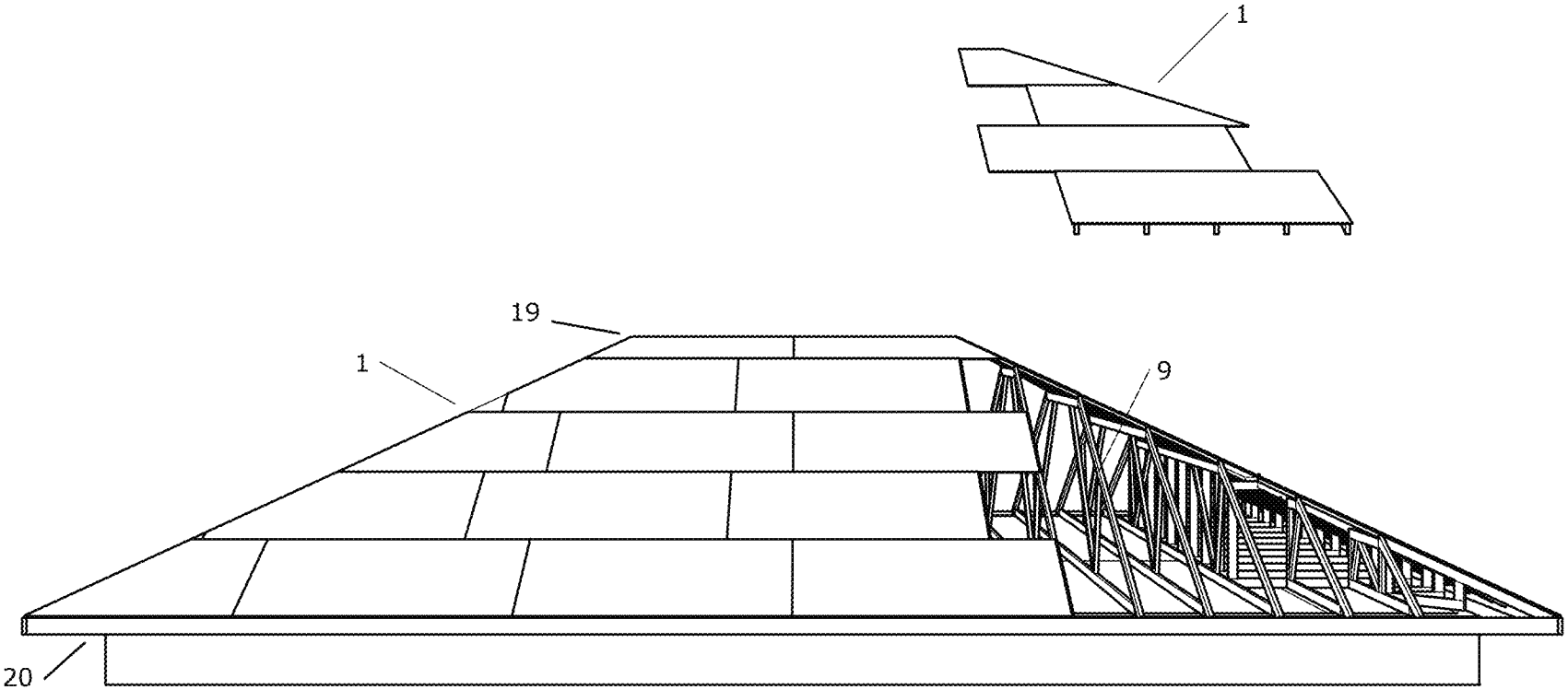
FIG. 6 shows another configuration of roof panels 1 on roof trusses 9.
Figure 7A:
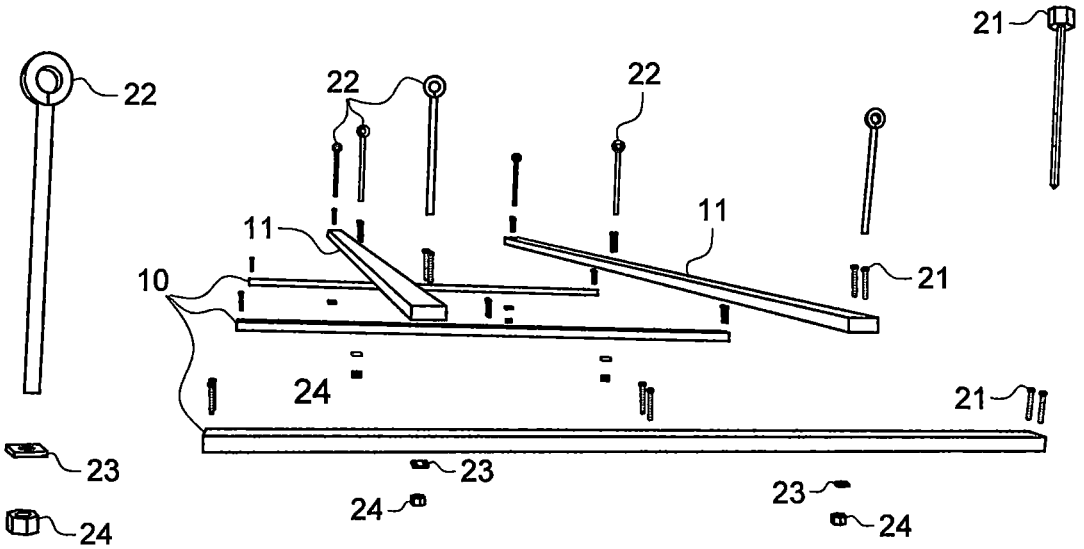
FIG. 7A is an exploded view of the two by four toe-kicks 10 with an extra two by four support board 11, along with lag bolts 21, tie-down anchor bolts 22, tie-down anchor bolt washers 23, and tie-down anchor bolt nuts 24.
Figure 7B:
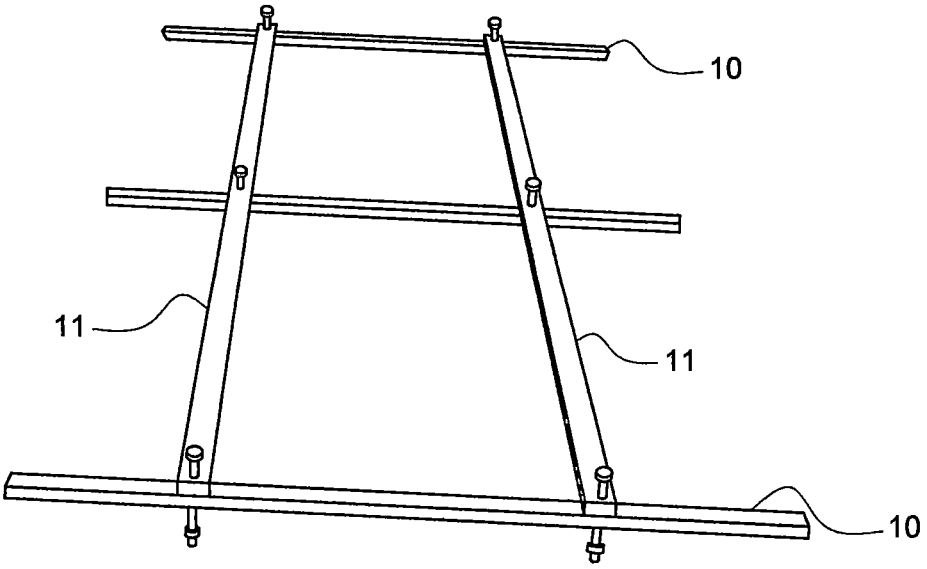
FIG. 7B shows two by four toe-kicks 10 and two by four support boards 11 as assembled.
Figure 8:
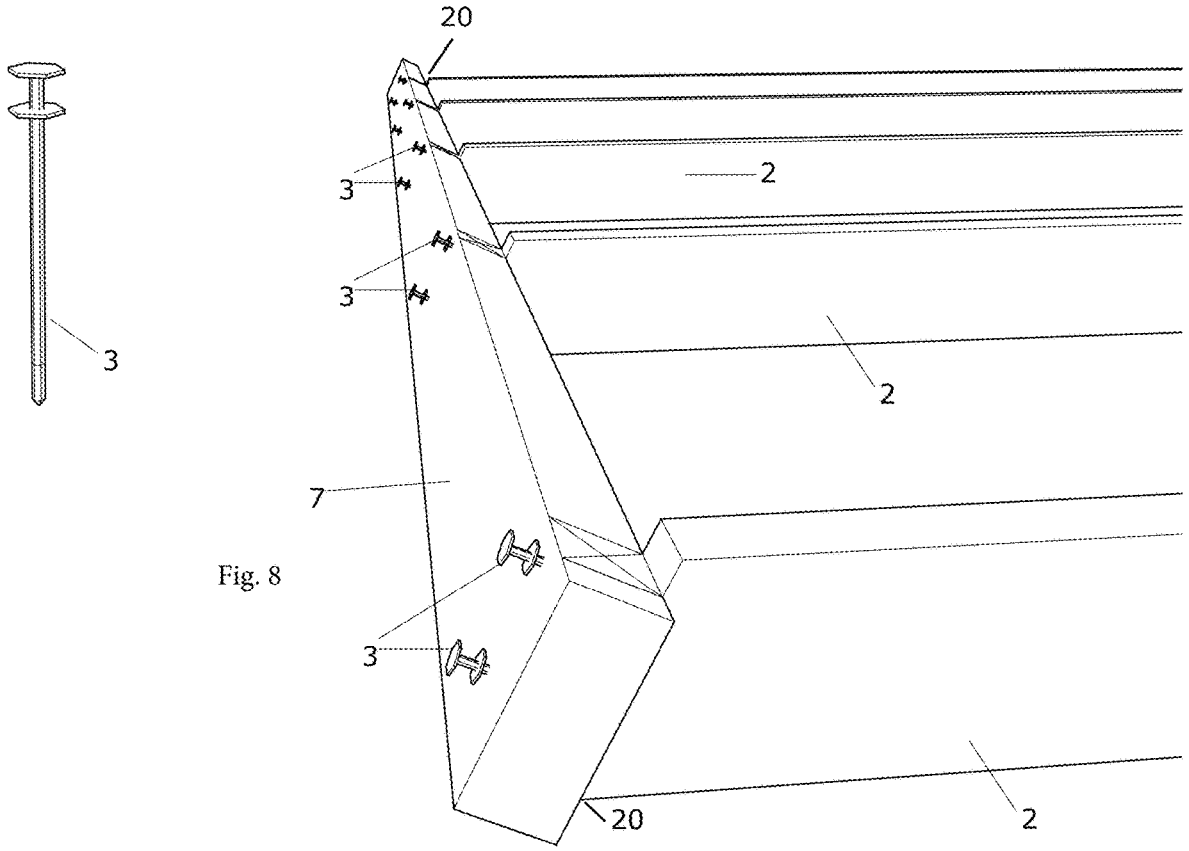
FIG. 8 is a perspective view of the removable two by four framing board 7 attached to each two by four rafter 2 by three inch duplex nails 3.
Figure 9:
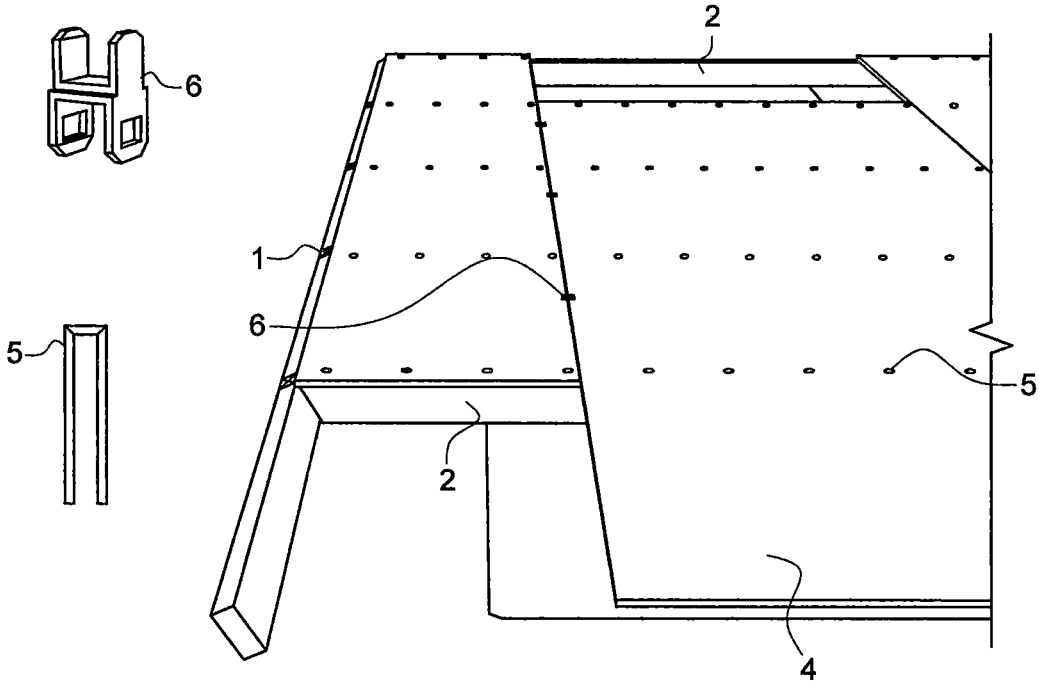
FIG. 9 is a view of the roof sheathing 4 of the roof panel 1 shown with the attached two by four framing board 7 and to the two by four rafters 2 with two and a half inch staples 5 and spaced with a sheathing clip 6.
Figure 10B:
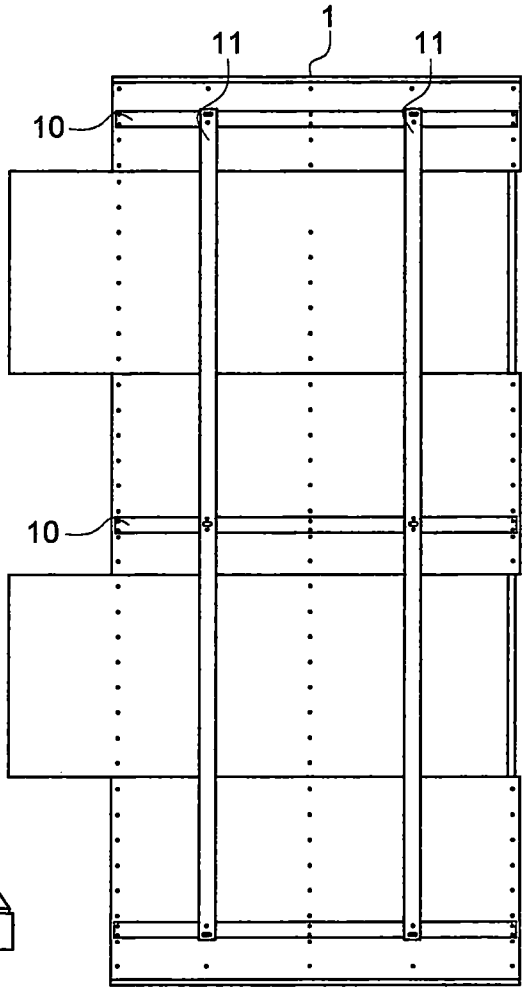
FIG. 10B is a top view of the roof panel 1 with the two by four toe-kicks 10 and extra two by four support boards 11 attached and ready to lifted up to the roof trusses 9 (not shown).
Figure 10A:
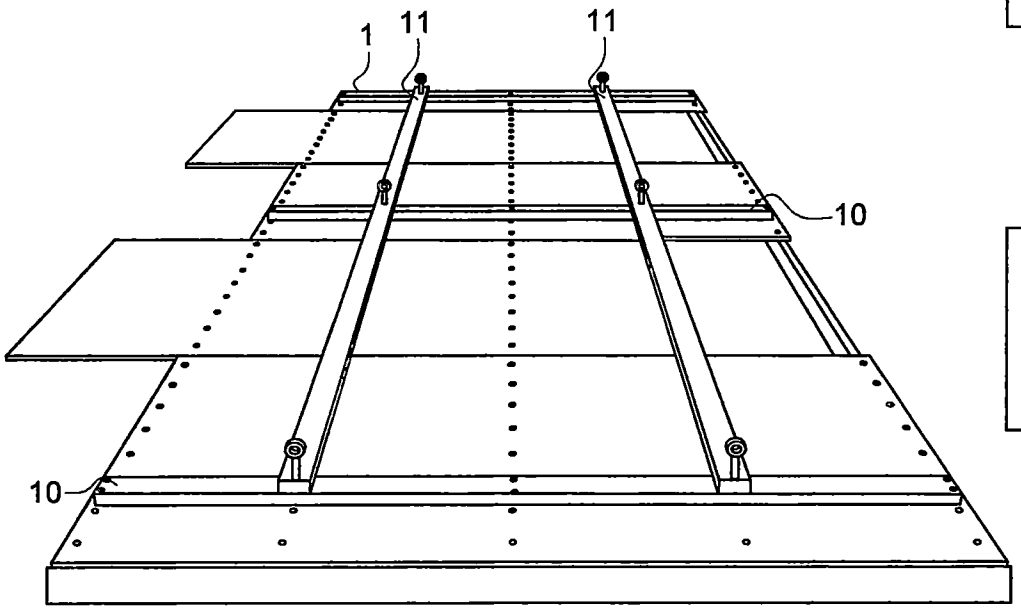
FIG. 10A is a perspective view of the roof panel 1 with the two by four toe-kicks 10 and extra two by four support boards 11 attached and ready to be lifted up to the roof trusses 9 (not shown).
Figure 11A:
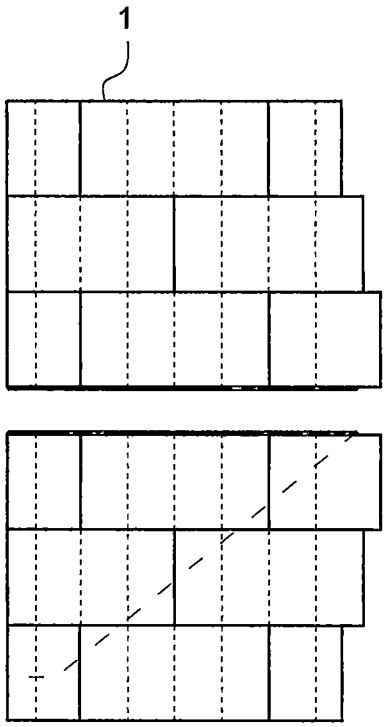
FIGS. 11A and 11B show roof panels 1 and the cuts needed to apply to a dormer 12.
Figure 11B:
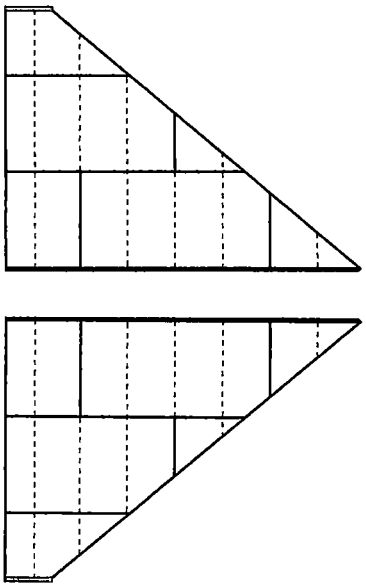
Figure 11C:
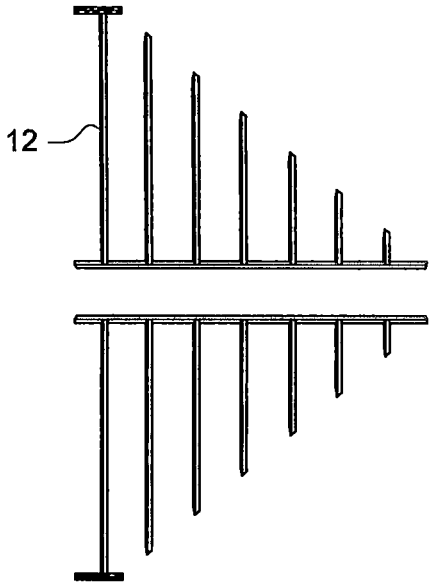
FIG. 11C shows the dormer 12.
Figure 12:
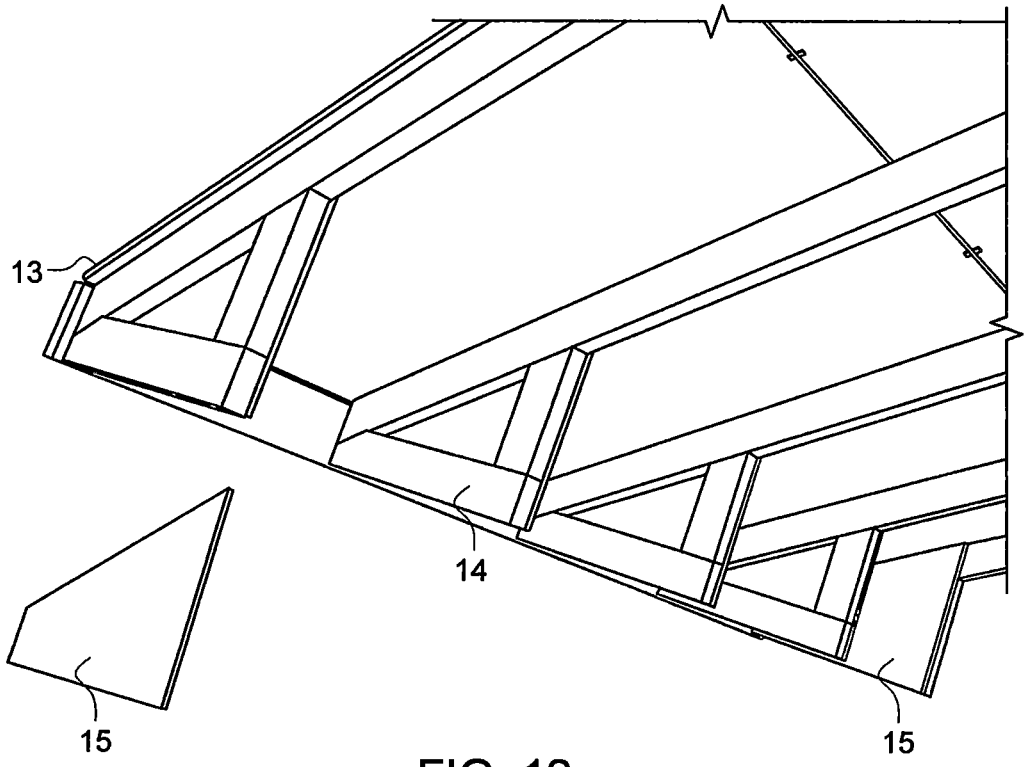
FIG. 12 is a perspective view of a roof panel 1 which includes a roof overhang 13 and dropped soffit 14 with plywood gussets 15.
Figure 13A:
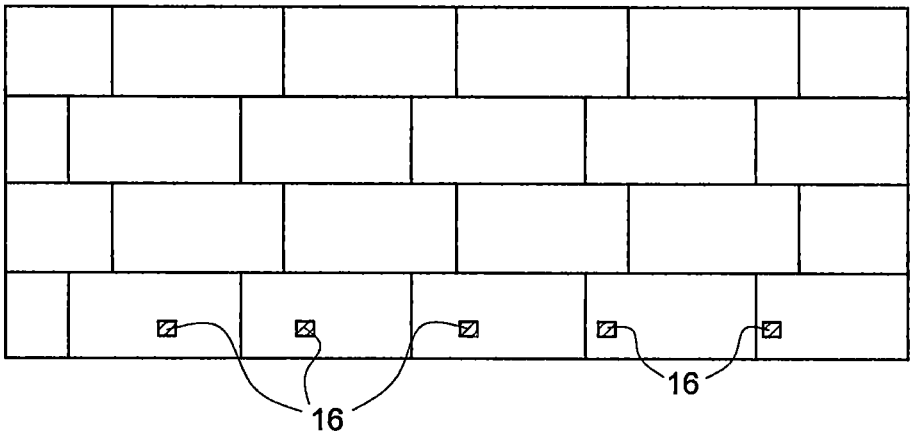
FIG. 13A is a top view of a roof panel 1 with roof vent cutouts 16.
Figure 13B:
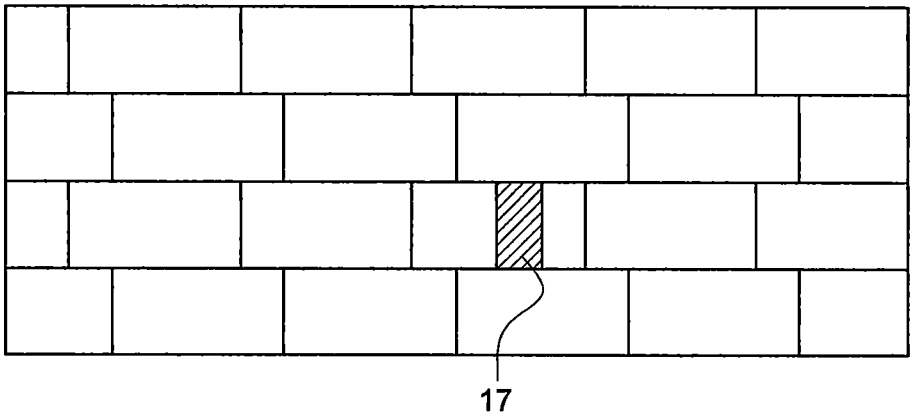
FIG. 13B is a top view of a roof panel 1 with a roof access panel cutout 17.
Figure 13C:
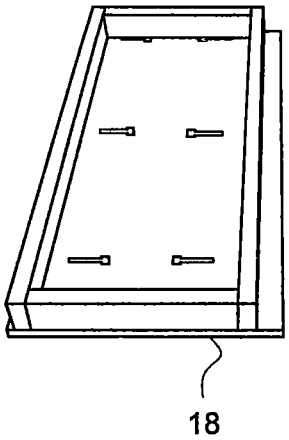
FIGS. 13C and 13D are bottom and top views of a roof access panel 18, respectively.
Figure 13D:
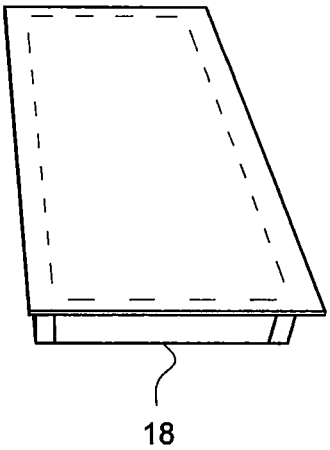
Figure 14A:
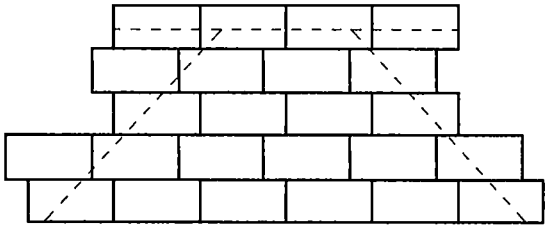
FIGS. 14A and 14B show the cuts on a roof panel 1 for a different configuration of a roof and FIG. 14C shows an exploded view of the roof panel 1.
Figure 14B:
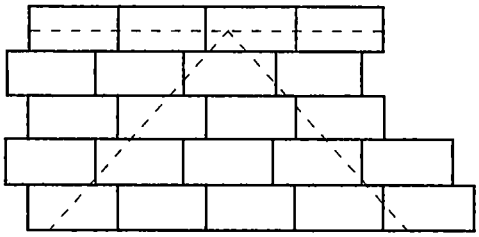
Figure 14C:
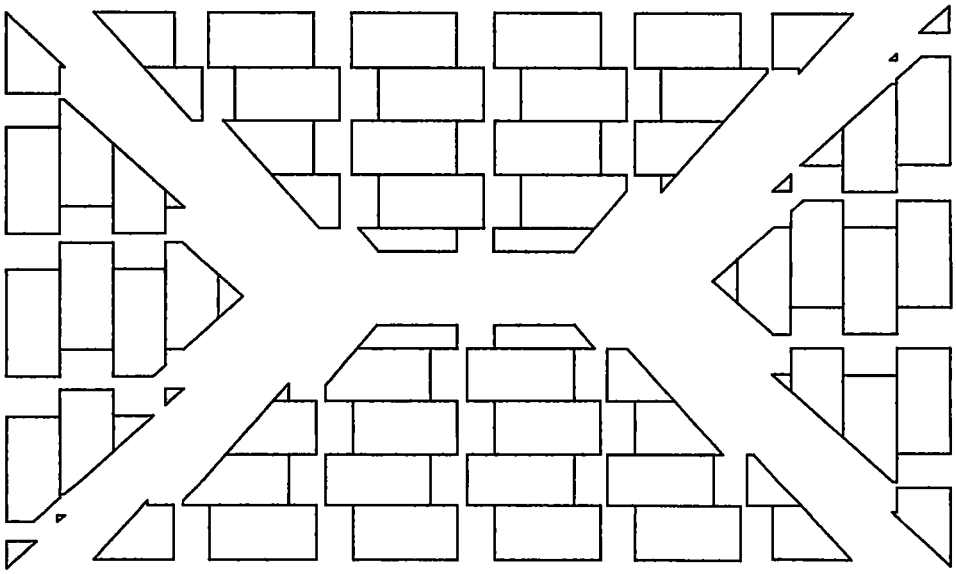

Initially, the dimensions of the roof, including roof truss layout, house dimensions, roof overhang 13, roof pitch, and top truss chord length are determined. The roof panels 1 are multi-edge panels, either pre-measured or cut to specifications, with a top ridge edge 19 and a bottom edge 20, two removable two by four framing boards 7, one of each situated at the top ridge edge 19 and the bottom edge 20, and a plurality of two by four rafters 2 attached to the removable two by four framing boards 7 at the top ridge edge 19 and bottom edge 20 at spaced intervals to match the roof truss layout. A plurality of roof sheathing 4, preferably plywood, are stapled to the two by four rafters 2 with a small space between each roof sheath. Once the roof panel 1 is formed, the removable two by four framing boards 7 are removed. Any necessary roof vent cutouts 16 and roof access panel cutouts 17 would then be cut into the roof sheathing 4 for placement of roof vents or a roof access panel 18, respectively.

For the craning process to lift the roof panel 1 up to the roof trusses 9, two by four toe-kicks 10 are removably attached to the roof sheathing 4 perpendicular to the roof trusses 9 and extra two by four support boards 11 are removably attached to the two by four toe-kicks 10 and situated perpendicular to the two by four toe-kicks 10. Appropriate sized holes are drilled at each intersection of the two by four toe-kicks 10 and extra two by four support boards 11 through which tie-down anchor bolts 22 are placed and attached to facilitate lifting the roof panel 1 to the roof trusses 9. Cable means are removably attached to each tie-down anchor bolt 22 and each roof panel 1 is lifted into place up onto the roof trusses 9, the bottom of each two by four rafter 2 is placed to abut up to the two by sis sub-facia 25 of the roof structure. When proper location is acquired, the two by four rafters 2 are nailed to the top truss chord of the house structure. This is repeated for all roof panels 1. After craning the roof panels 1, and preferably after the two by four rafters 2 are nailed to the top truss chord, each roof panel 1 is stapled at the seam of each roof sheathing 4 to each adjacent roof sheathing 4 of each roof panel 1. This process is repeated for each roof slope. The stapling at the seams of adjacent roof sheathing may also be done prior to raising the roof panel up to the building trusses.

The roof panels 1 are made out of any type of acceptable roofing material, such as plywood, pressed wood panels, manufactured wood, similar roofing sub-base material or the like.

Alternative embodiments include situating roof sheathing 4 either horizontally or vertically onto the panel fame 8 or combining the configurations by situating the roof sheathing 4 alternating between a horizontal and vertical direction, cutting a roof panel 1, or multiple roof panels 1 that have been attached together, to fit and meet the dimensions of a dormer or a non-rectangular roof section.

I claim:

1. A method of constructing full and partial roofs for buildings comprising a roof panel constructed at ground level, the roof panel comprising a top ridge edge and a bottom edge, and a top and a bottom, the roof panel further comprising a panel frame, the panel frame comprising two removable two by four framing boards, one of each situated at the top ridge edge and the bottom edge, and a plurality of two by four rafters attached perpendicular to and abutting the removable two by four framing boards at the top ridge edge and the bottom edge at spaced intervals to match a roof truss layout, a plurality of roof sheathing fixedly attached to the two by four rafters forming a panel frame top with the roof sheathing and a panel frame bottom without the roof sheathing, a plurality sheathing clips inserted between each roof sheathing defining a small space between each roof sheathing, attaching means to attach each roof sheathing to the two by four rafters, and staples to attach each roof sheathing to any adjacent roof sheathing.

2. The roof panel of claim 1 wherein the roof sheathing is fixedly attached horizontally to the two by four rafters, or attached vertically to the two by four rafters, or attached in a combination of horizontal and vertical configurations to the two by four rafters.

3. The roof panel of claim 2 wherein the attaching means to fixedly attach the roof sheathing to the two by four rafters is one or more of staples, nails, or other like means.

4. The roof panel of claim 3 wherein the roof sheathing is plywood, pressed wood panels, manufactured wood, or similar roofing sub-base material.

5. The roof panel of claim 4 wherein the roof panel comprises one or more roof vent cutouts for placement of roof vents.

6. The roof panel of claim 5 wherein the roof panel comprises one or more roof access panel cutouts for placement of roof access panels.

7. The roof panel of claim 6 wherein the removable two by four framing boards are removed in preparation for hoisting the roof panel up onto roof trusses of a building.

8. The roof panel of claim 7 wherein one or more two by four toe-kicks are removably attached to the roof sheathing perpendicular to the roof trusses and one or more two by four support boards are removably attached to the two by four toe-kicks and situated perpendicular to the two by four toe-kicks forming intersections of the two by four toe-kicks and two by four support boards.

9. The roof panel of claim 8 wherein a hole is drilled at each intersection of the one or more two by four toe-kicks and the one or more two by four support boards, through which a tie-down anchor bolt is placed and attached to facilitate lifting the roof panel to the roof trusses, and cable means are removably attached to each tie-down anchor bolt to facilitate hoisting the roof panels onto the roof trusses.

10. The roof panel of claim 9 wherein each roof panel is lifted into place up onto the roof trusses, the bottom of each two by four rafter is placed to abut up to a two by six sub-facia of the roof structure, and the two by four rafters are nailed to a top truss chord of the building.

* * * * *